US009061867B2

(12) United States Patent
Bjørshol et al.

(10) Patent No.: US 9,061,867 B2
(45) Date of Patent: Jun. 23, 2015

(54) DEVICE FOR A CRANE FOR MOVEMENT CONTROL OF A HOISTING WIRE, AND USES THEREOF

(75) Inventors: Øyvind Bjørshol, Averøy (NO); Johnny Lorgen, Brattvåg (NO)

(73) Assignee: ROLLS-ROYCE MARINE AS, Brattvag (IT)

( * ) Notice: Subject to any disclaimer, the term of this patent is extended or adjusted under 35 U.S.C. 154(b) by 613 days.

(21) Appl. No.: 13/059,672

(22) PCT Filed: Aug. 25, 2009

(86) PCT No.: PCT/NO2009/000301

§ 371 (c)(1),
(2), (4) Date: Feb. 18, 2011

(87) PCT Pub. No.: WO2010/024690

PCT Pub. Date: Mar. 4, 2010

(65) Prior Publication Data

US 2011/0163057 A1 Jul. 7, 2011

(30) Foreign Application Priority Data

Aug. 25, 2008 (NO) ..... 20083643

(51) Int. Cl.
*B66C 13/06* (2006.01)
*B66C 23/10* (2006.01)
*B66C 23/00* (2006.01)

(52) U.S. Cl.
CPC ..... *B66C 23/10* (2013.01); *B66C 13/06* (2013.01); *B66C 23/54* (2013.01)

(58) Field of Classification Search
CPC ..... B66C 13/06; B66C 1/101; B66C 1/20; B66C 1/223; B66C 1/36; B66C 13/04; B66C 23/10; B66C 23/54
USPC ..... 212/272, 273, 274, 259, 260
See application file for complete search history.

(56) References Cited

U.S. PATENT DOCUMENTS 1,830,442 A * 11/1931 O'Rourke ..... 212/272
2,187,714 A * 1/1940 Woodeson et al. ..... 212/272

(Continued)

FOREIGN PATENT DOCUMENTS

CN 1548357 11/2004
JP 10324492 8/1998

*Primary Examiner* — Emmanuel M Marcelo
*Assistant Examiner* — Justin Stefanon
(74) *Attorney, Agent, or Firm* — Abelman, Frayne & Schwab

(57) ABSTRACT

A device associated with a crane is described for the control of unwanted movements of a load that is connected to a hoisting line (14) via a number of branch hoisting wires (28, 29), and it is characterised in that the crane derrick comprises means that are arranged to push against the branch wires to dampen and eliminate the unwanted movements. According to the invention the device is used to control rotary movements of a container with four hoisting wires connected to a hook (36) at the end of the main hoisting wire (14) and the arm (22) is unfolded into an approximately vertical position, the two branch arms (28, 29) are folded out into a T-shape (FIG. 5), the arm is rotated further so that the branch arms (30, 32) push against the branch wires (28, 29) with a power sufficient to prevent the container from moving in unwanted ways. According to one variant, a device associated with a crane is proposed for the control of the hoisting line (13) itself for a load. In this solution the arm (22) comprises a hoop part (131,132) arranged to be adjusted from a passive, storage position in the arm part to an active position encircling the hoisting line. An application of the device is also described.

6 Claims, 6 Drawing Sheets

(56) References Cited

U.S. PATENT DOCUMENTS

| | | | | | |
|---|---|---|---|---|---|
| 2,805,781 | A | * | 9/1957 | Senn | 212/274 |
| 2,916,162 | A | * | 12/1959 | Gercke | 212/273 |
| 3,191,779 | A | * | 6/1965 | Thomson | 212/274 |
| 3,912,088 | A | * | 10/1975 | Bronfman | 212/274 |
| 4,171,053 | A | * | 10/1979 | Cecce | 212/274 |
| 4,273,242 | A | * | 6/1981 | Schaper | 212/273 |
| 4,818,172 | A | * | 4/1989 | Johnson | 414/686 |
| 4,932,541 | A | * | 6/1990 | Belsterling | 212/308 |
| 5,215,202 | A | | 6/1993 | Fujimoto | |
| 5,727,702 | A | * | 3/1998 | Kullmann et al. | 212/273 |
| 6,021,911 | A | * | 2/2000 | Glickman et al. | 212/345 |
| 6,439,407 | B1 | * | 8/2002 | Jacoff et al. | 212/274 |
| 2009/0301983 | A1 | | 12/2009 | Lorgen | |

* cited by examiner

DEVICE FOR A CRANE FOR MOVEMENT CONTROL OF A HOISTING WIRE, AND USES THEREOF

Device associated with a crane to control the movements in a hoisting line, and applications thereof.

The present invention relates to a device associated with a crane for dampening and eliminating unwanted movements, such as load rotation, in loads hanging on a hoisting line, as described in the introduction to the following claim 1. The invention also relates to a construction associated with a crane to be able to control the movements in a main hoisting line. The invention also relates to an application of the device.

It is a well known problem that a load which hangs on a hoisting line of a crane begins to swing and swivel or rotate about an axis through the hoisting wire when the load is operated by the crane.

There have been many attempts to resolve this, including that one places the driving bodies (propellers, jet bodies and the like) onto the loading hook to compensate for rotary movements.

It is further known that, for example, containers that hang in up to four or more branch wires up to the crane hook and the one loading wire that runs over a derrick pulley in the crane derrick.

Here the hoisting line means a wire, rope, chain or the like which is used in conjunction with winches in a crane construction.

With regards to prior art, the Japanese patent publication JP-10324492 shall be referred to. According to the Japanese solution the tip of the main crane is designed with an extra derrick split into two, the one/lower end of which comprises a device which can stabilize a main wire which the load is hanging on via branch wires. The main wire shall be led down through and be surrounded by this device at the tip of the extra derrick, and reference is given to FIGS. 4 and 5, detail FIG. 16 in the Japanese publication.

The conclusion is that this solution is not intended to dampen the rotary motion that the load may be exposed to in the branch wires themselves.

The Japanese publication shows an additional derrick with two main arms with the purpose of regulating the height from the disk housing on the crane and down to where the device touches the load or the wires which the load is suspended on. This regulation of height is used to hoist the device up along the main wire to get it out of the way. (FIG. 1). There is no reference to means that will control the rotational movement through the branch wires, which is one of the aims of the present invention. Instead the Japanese solution shows a claw form that will grab the hook itself which the load or branch wires to a container are suspended from in order to stabilize and force rotate the load.

The extra derrick is thus a very complex construction, and which shall not be arranged in parallel with the main derrick, and it stands in the way for all the movements that a crane is expected to be able to perform. Moreover, this crane is designed to handle loads which are to be transferred between two vessels, as the figures show.

PURPOSE OF THE INVENTION

It is an aim of the invention to provide a construction of a crane that will completely solve the above mentioned problems.

In more detail, it is an aim to construct a solution which stabilises a load, and that shall only touch two of the applied branch hoisting wires, and not the load itself or the main hoisting wire as shown in the Japanese patent.

In particular, it is an aim of the invention to provide a solution where a load which is suspended by a hook through at least two branch wires, such as a container (four-branch wires), can be stabilised and controlled in a simple way.

Furthermore, it is an aim to provide a solution where the crane derrick itself comprises means that can exert such control.

It is further aim to provide a construction in the crane derrick that can be adjusted from a passive, parked position to an active, rotation controlling position for a load which is hanging on at least two load wire branches below the crane hook.

It is also an aim of the invention to provide a new solution to control the movements to a main hoisting line/wire, whether this is connected to a load or not.

It is another aim of this solution to be able to use the branch wire-controlling construction of the crane to also control a main wire.

DESCRIPTION OF THE PRESENT INVENTION

The device according to the invention is characterised in that the crane derrick comprises means that are set up to lie against the wire branches, comprising arm parts that can be unfolded and which are set up to be adjusted from a passive, parked position in connection with the crane derrick to an active position to lie against the branch lines for the load.

Preferably the means comprise an arm with branch arms which are set up to be adjusted from a passive, parked position in relation to the derrick to an unfolded, active movement dampening and moment controlling position of a load.

According to another alternative the branch arms are arranged at the end of the arm which can be unfolded.

According to a preferred embodiment the arm is set up to be rotated from a parked position integrated into the position of the derrick to a downwardly directed, unfolded, active position, such as with the help of piston/cylinder units.

According to yet another preferred embodiment, the arm is set up to be rotated up to 120° relative to the derrick.

According to yet another preferred embodiment the arm comprises a number, preferably two, of branch arms which can be unfolded so that the unit, together with the main branch, forms a T-shape in its active use position.

According to yet another preferred embodiment the branch arms are rotary in that they are folded and lie in parallel with the main arm.

According to yet another preferred embodiment the branch arms are adjusted between the two positions by means of a hydraulically driven system.

The device according to another embodiment for control of rotary movements, is characterised in that the arm part comprises a hoop part set up to be adjusted from a passive, storage position in the arm part to an active, encircling rest position surrounding the hoisting line.

According to a preferred embodiment it is comprised by two half-hoop parts which are individually set up to be pushed out of a holder part in the arm part to form an annular shape surrounding the hoisting line to catch and stabilise the hoisting line.

According to yet another preferred embodiment the holder part with the hoops is arranged at the end of arm part.

According to yet another preferred embodiment the arm part comprises an additional, telescopically extendable arm section and the holder part with the hoops is arranged at the end of the arm section.

According to yet another preferred embodiment the permanent arm part comprises branch arms which can be unfolded as defined in claims 1-8.

According to the invention the device is used according to claims 1-8 to control the rotary movements of a container with four hoisting wires connected to a hook at the end of the main hoisting wire and the arm is unfolded into an approximately vertical position, the two branch arms are unfolded into the T-shape (FIG. 5), the arm is further rotated so that the branch arms push against the branch wires with sufficient power so that the container stops moving in unwanted ways.

The invention will be explained with reference to the enclosed figures, in which.

Figure 10:
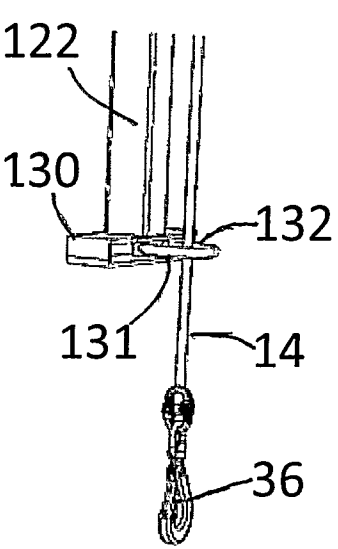
Figure 9:
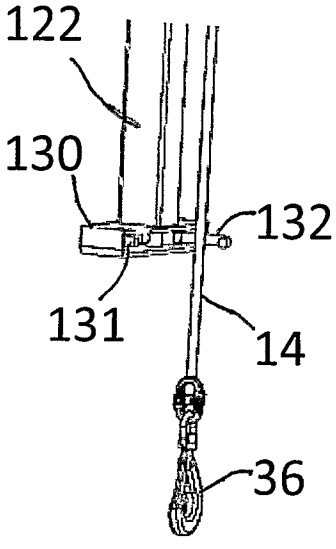
Figure 8:
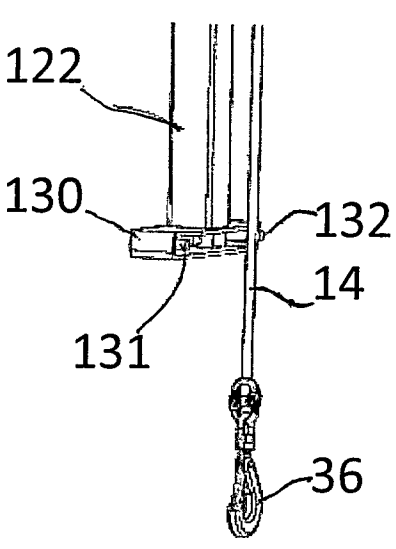

The FIGS. 8-10 show different positions of an extendable hoop which is used to stabilise a main hoisting line, according to this variant.

SPECIFIC PREFERRED EMBODIMENTS

Reference will now be made to the figures that show different outlines and cross sections of a crane construction according to the invention, and which, when carried out, will meet the objectives that are outlined above, such as the unwanted movements of the hoisting line (and a load/container) can be brought under control in a simple way.

A First Embodiment

Figure 1:
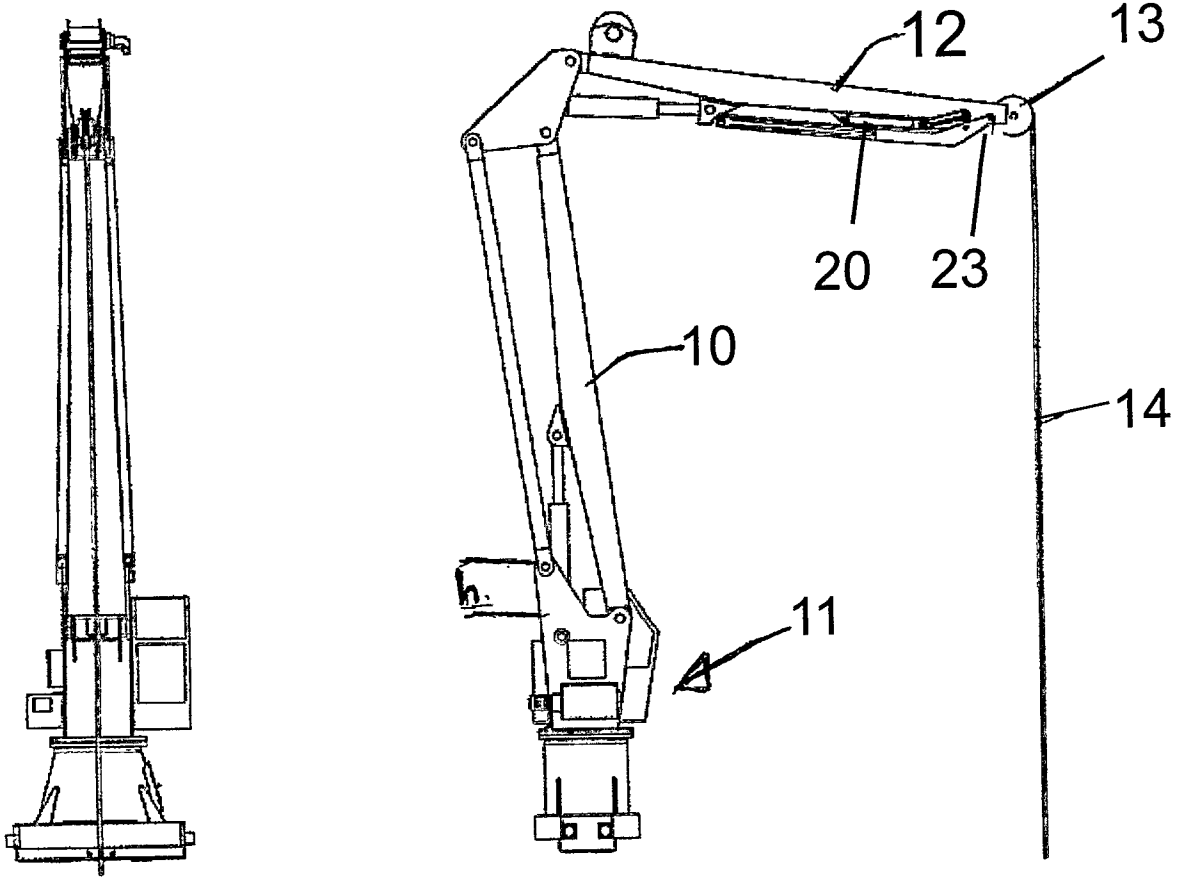
FIG. 1 shows a crosswise and sidewise outline of a crane construction with the device according to the invention in a folded position.
Figure 2:
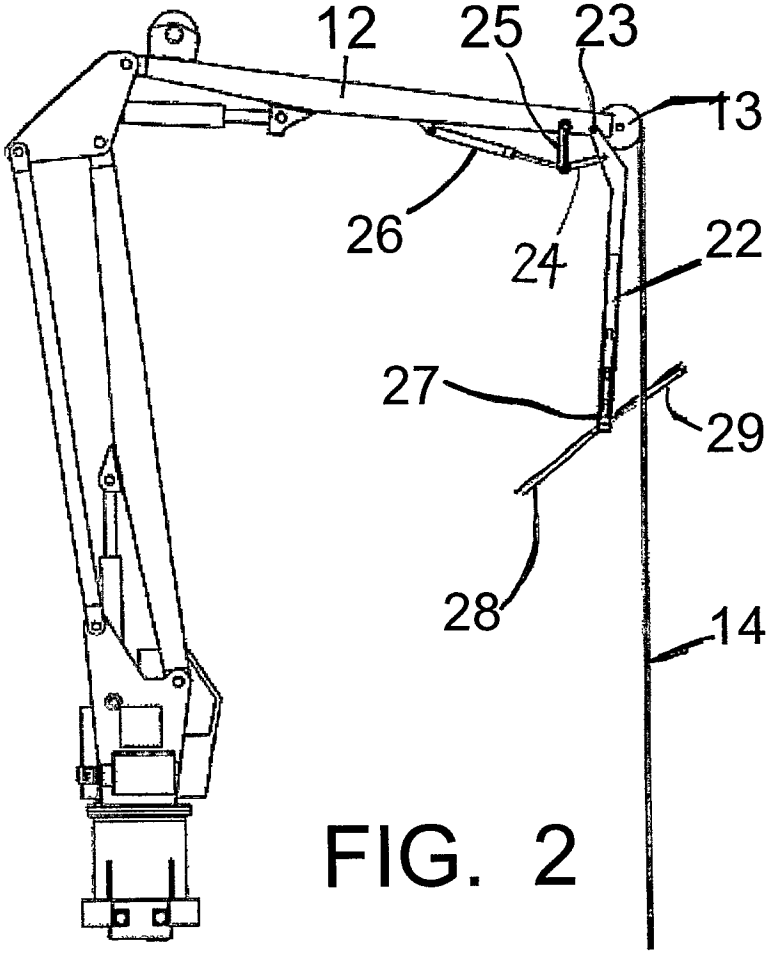
FIGS. 2 and 3 show the corresponding crosswise and sidewise outline with the device in an unfolded use position.
Figure 3:
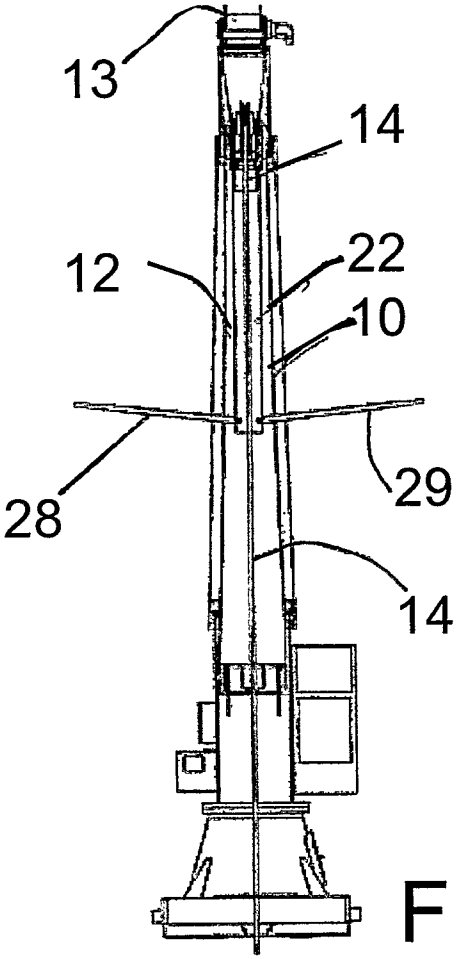
Figure 4:
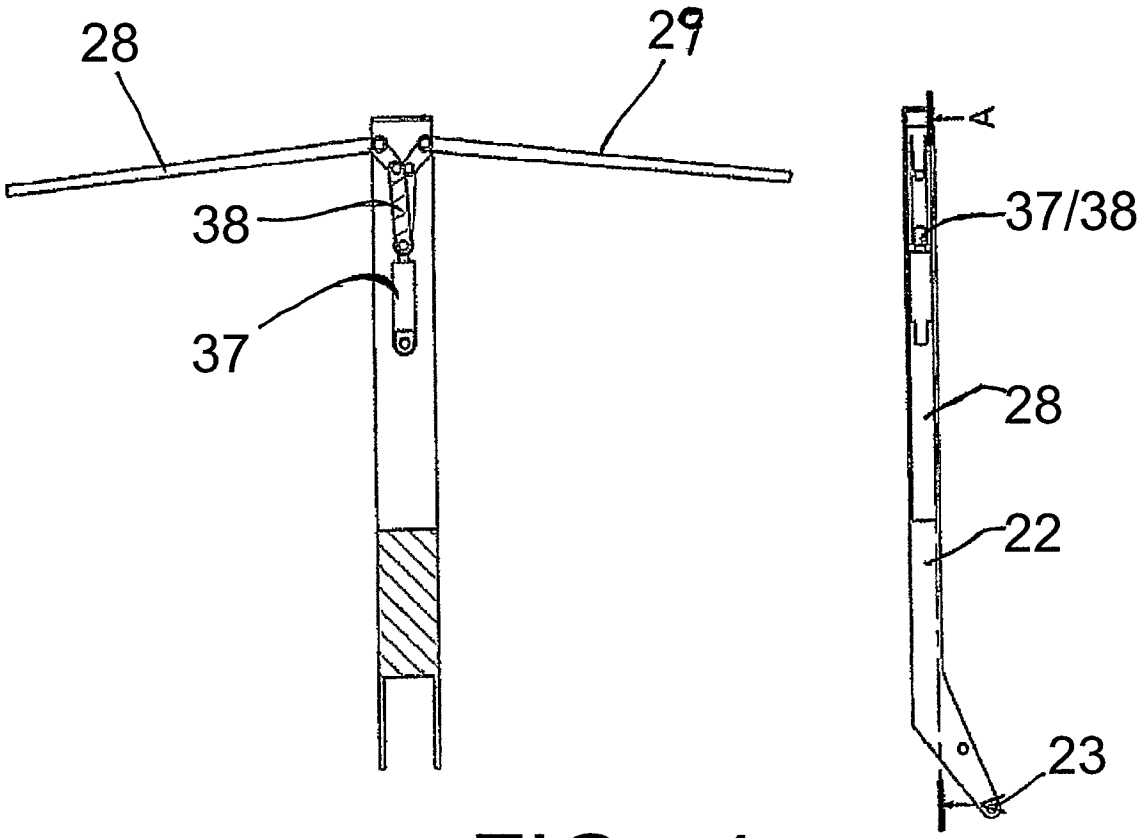
FIG. 4 shows details of the branch arm construction.

FIG. 1 shows an example of a crane 11 where the invention may be applied. The crane, for example, on board a ship, is mounted on a plinth part in a suitable deck on the ship, and comprises a vertical derrick 10 and a horizontal derrick 12. It is the inventive construction at the tip of the underside of the horizontal derrick 12 which is interesting in this context. The figure also shows a runner pulley 13 on the outer end of the derrick 12 to a corresponding hoisting wire 14.

With reference to the FIGS. 1, 2, 3 and 4, the inventive construction 20 is shown in the underside of the outer derrick. It includes an elongated arm 22 that is rotary mounted to the derrick 12 in the point 23 adjoining the pulley 13.

Figure 5:
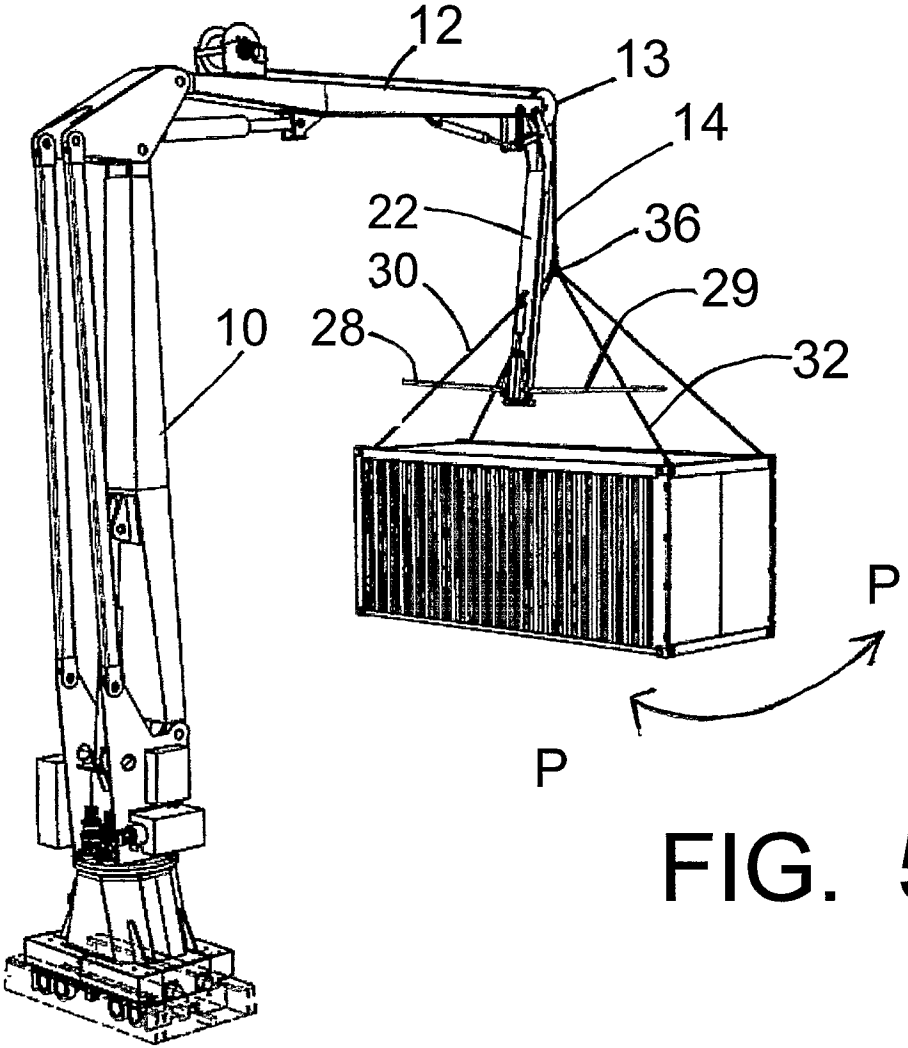
FIG. 5 shows how the movements of a load (container) are controlled with the invention.

The arm 22 is rotated from a parked position to a downwardly hanging, active position with the help of articulated arms 24,25 with the help of the piston/cylinder unit 26. This is driven hydraulically in a way not shown further. The figures show that the arm is rotated approximately 90° in relation to the derrick 12. Two guiding arms 28,29 which can be unfolded are arranged on the freely hanging arm end 27 so that they together with the main arm 22 form a T-shape in its active use position. This is most clearly shown in FIG. 3. In a passive position they are rotated so that they are folded and lie in parallel with the main arm. These arms 28,29 are also adjusted between the two positions by means of a hydraulically driven system which is not described further here. According to the invention the arm 22 can be rotated further out than 90°, such as up to 120° in relation to the derrick for the purpose that every branch arm shall be able to push against its individual branch wire 30,32, as is best shown in FIG. 5. When in its use position the arm 22 preferably faces vertically or in an approximately vertical position.

FIG. 5 shows the invention schematically in practical use to control the rotary movements of a load with two or more hoisting wires connected to a hook 36 at the end of the main hoisting wire 14. The load, shown here as a container, has a tendency to swing back and forth as indicated by the arrows P. It will also be able to take up many other swing patterns that shall not be described here in detail. Such rotations slow the handling of the load very much, and it leads to risks for the personnel who are going to attach and detach the load from the hoisting hook 36.

With the invention, the arm 22 is unfolded down into an approximately vertical position, the two branch arms 28,29 are unfolded into the T-shape which is shown in FIG. 5, the arm is rotated further about the joint 23 so that it pushes against the branch wires 30,32 with a power sufficient to make the container stop moving in unwanted ways, as described above.

A Second Embodiment

Control of Movements in a Main Hoisting Line

The FIGS. 6-10 show how a construction according to the invention in a crane can be used to gain control of unwanted movements of the main hoisting line 14 to which a load is connected that is to be operated by the crane. As in the previous solution for control of the movements of a container, this solution also includes an arm part 22 that can be unfolded. This is shown unfolded in the FIGS. 6 and 7.

The lower end of the arm part 22 comprises a holder part 130 in which two extendable half-hoop parts 131,132 (made from metal) are inset. These can be adjusted to an active, encircling position about the hoisting line 14 in that they are pushed out of the holder. They are then moved in an arch shape from the position shown in FIG. 8 to the position shown in FIG. 10. FIG. 9 shows the initial pushing out movements of the one hoop part 132 to catch the hoisting wire 14 that swings back and forth with the pulley 13 as the swing axis. When it passes the holder 130, it will be caught by the half hoop part 132. Thereafter, the other hoop 131 is pushed out so that the two form a closed ring. The hoisting line 14 is then captured free-moving to be hoisted and lowered through the ring. The swing movements of the hoisting line 14 can then be brought under control. The pushing out and pulling in of the hoops can be carried out by an electric/hydraulic drive system fitted on the inside of the holder housing 130.

According to one embodiment the holder part 130 can be mounted at the end of the one arm part 22.

Figure 6:
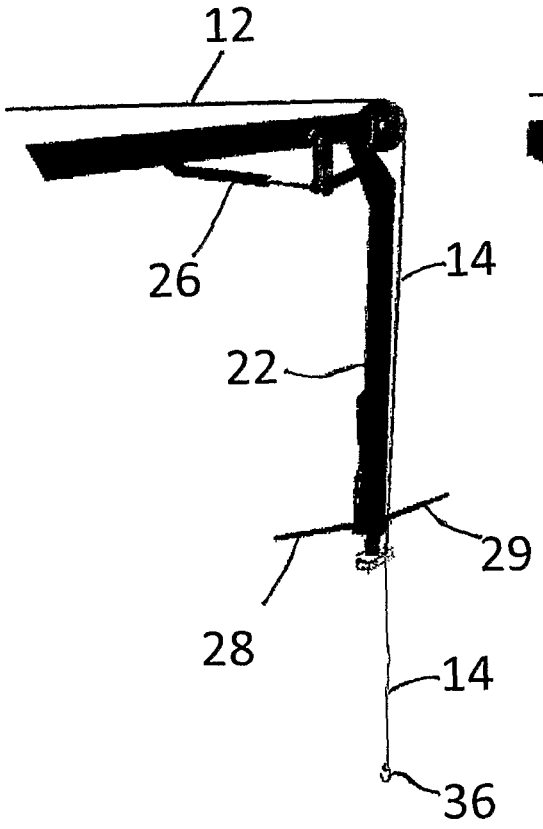
FIGS. 6 and 7 show the side outline of a crane derrick, according to one variant of the invention for the control of movements in the hoisting line itself.

According to a second embodiment the arm 22 comprises an additional, telescopically extendable rod 122, onto the end of which is fitted said holder part 130 with the hoop parts 131,132. FIG. 6 shows the telescopic arm 122 recessed in the arm 22, while FIG. 7 shows the telescopic arm 122 in an extended position.

In this embodiment, the arm 22 can still encompass the two branch arms 28,29 which can be unfolded that are originally intended to stabilise a load hanging in the branch wires from a hoisting line.

Figure 7:
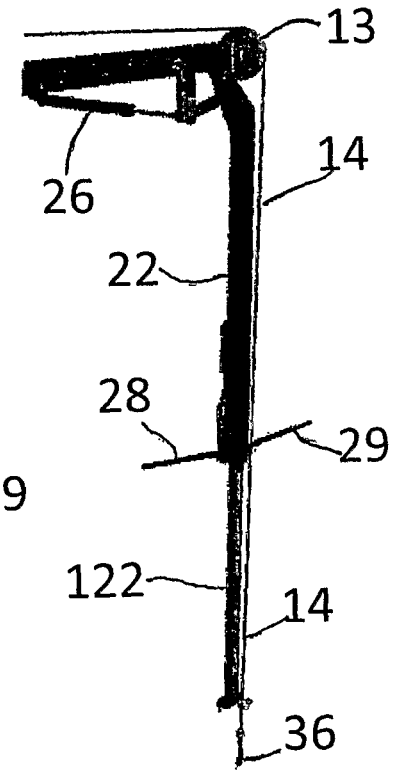

In this embodiment with the hoop bodies to stabilise the hoisting line itself, the branch arms, as shown in FIGS. 7 and 8 can be used for initial stabilisation and guide the hoisting line 14 so that it can be moved into the hoop 123 (FIG. 9) more easily, whereupon both the hoops 131,132 form the closed up ring shape. As FIG. 7 shows the arm parts 28,29 are positioned higher up on the arm construction 22,122 than the hoop parts 131,132.

This version which is outlined in connection with FIGS. 6-10, can, for example, be suitable for control of the movements when a hose, for example, on board a vessel, shall be handled by the crane. By hooking the end of the hose to the hook 36, the swing movements can be closely controlled by capturing the main hoisting line 14 in the hoop construction. Thus, the hose can be moved without coming into uncontrollable swing movements.

The inventive solutions will therefore, to a large extent, increase the safety of the personnel on board the vessel so that the risk of injury is reduced significantly.

The invention claimed is:

1. A method of controlling unwanted movements of a load suspended by at least two branch hoisting lines (30, 32) connected to a hook (36) provided at an end of a main hoisting line (14) of a crane, the method comprising the steps of providing a device having a main arm (22) rotatably mounted to a horizontal derrick (12) of the crane and displaceable from a folded parked position in which the main arm (22) extends substantially horizontally and is integrated in the derrick (12), to an unfolded approximately vertical active position, the main arm (22) having branch arms (28, 29) rotatably mounted at the end of the main arm and unfoldable from a folded position in which they extend substantially parallel to the main arm (22), to an active position in which the branch arms (28, 29) bear against branch hoisting lines (30, 32); unfolding the main arm (22) downwardly into an approximately vertical position, with the branch arms being unfolded to form, together with the main arm a T-shape profile; and further rotating the main arm (22) until the branch arms (28, 29) bear against the branch hoisting lines (30, 32) with a force to stop the unwanted movements of the load.

2. A device associated with a crane for controlling unwanted movements of a load supported by a plurality of branch hoisting lines (30, 32) connected to a crane hoisting line (14) suspended from a horizontal derrick (12) of the crane, the device comprising a main arm (22) rotatably mounted to the derrick (12) and displaceable from a folded parked position in which the main arm extends substantially horizontally and is integrated in the derrick to an unfolded active approximately vertical position, the main arm (22) having a plurality of branch arms (28, 29) rotatably mounted at the end of the main arm (22) and unfoldable from a folded position in which they extend parallel to the main arm (22), to an unfolded active position in which they form, together with the main arm, a substantially T-shape profile and bear against branch hoisting lines (30, 32).

3. A device according to claim 2, wherein the main arm (22) rotatably mounted in the derrick (12) in a point (23) adjoining a pulley (13) for conducting the hoisting line (14).

4. A device according to claim 2, wherein the main arm (22) is rotatable relative to the derrick (12) by up to 120° .

5. A device according to claim 2, further comprising a piston/cylinder unit (26) for rotating the main arm (22).

6. A device according to claim 2, wherein the branch arms (28, 29) are displaceable between the folded position of the branch arms and the active, unfolded position of the branch arms by hydraulically driven means.

* * * * *